US005693073A

United States Patent [19]

Glick et al.

[11] Patent Number: 5,693,073

[45] Date of Patent: Dec. 2, 1997

[54] VIBRATING PACIFIER

[76] Inventors: Fred S. Glick, 5888 Liberty Rd., Solon, Ohio 44139; C. Peter Cimoroni, 180 Linwood La., Aurora, Ohio 44202; William T. Mars, 1943 Old Forge Rd., Kent, Ohio 44240

[21] Appl. No.: 687,083

[22] Filed: Jul. 23, 1996

[51] Int. Cl.[6] ..... A61J 17/00

[52] U.S. Cl. ..... 606/236

[58] Field of Search ..... 606/234–236; D24/194–198

[56] References Cited

U.S. PATENT DOCUMENTS

| | | | |
|---|---|---|---|
| D. 249,161 | 8/1978 | Rohrig . | |
| 1,582,003 | 4/1926 | Griffiths . | |
| 2,743,727 | 5/1956 | Griesinger . | |
| 3,115,139 | 12/1963 | Schneider . | |
| 3,375,381 | 3/1968 | Tavel . | |
| 3,563,233 | 2/1971 | Bodine . | |
| 4,481,949 | 11/1984 | Kesselring et al. . | |
| 4,554,919 | 11/1985 | Hubert . | |
| 4,716,902 | 1/1988 | Swartz . | |
| 5,019,095 | 5/1991 | Lu . | |
| 5,044,356 | 9/1991 | Fishman et al. . | |
| 5,109,864 | 5/1992 | Lu . | |
| 5,292,335 | 3/1994 | Shin . | |
| 5,342,398 | 8/1994 | Sun . | |
| 5,534,013 | 7/1996 | Zeindler | 606/234 |
| 5,611,622 | 3/1997 | Wang | 606/234 |

*Primary Examiner*—Gary Jackson

*Attorney, Agent, or Firm*—Pearne, Gordon, McCoy & Granger LLP

[57] ABSTRACT

Disclosed is a vibrating infant pacifier. The pacifier is compact and lightweight and provides a nipple vibrationally isolated from the outer housing of the device. The housing encloses a tuning fork vibrator unit that employs a coil which generates an oscillating magnetic field in the presence of a flexible spring and magnet assembly.

21 Claims, 2 Drawing Sheets

Fig.1
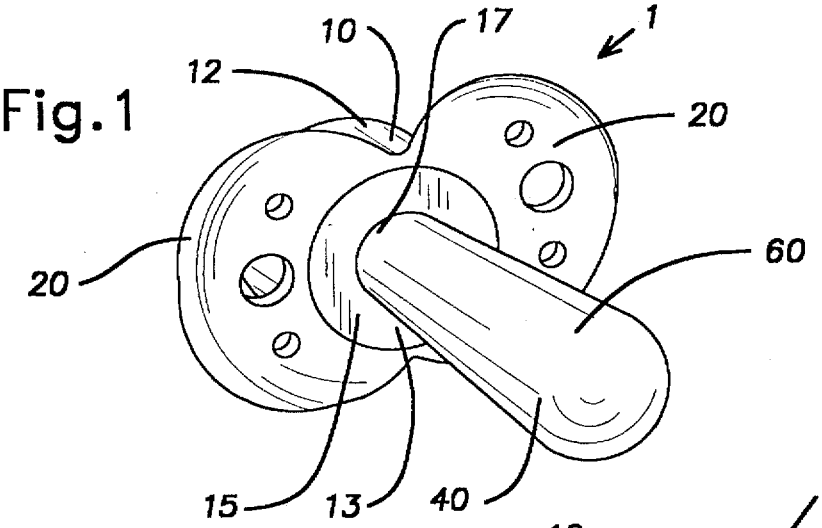
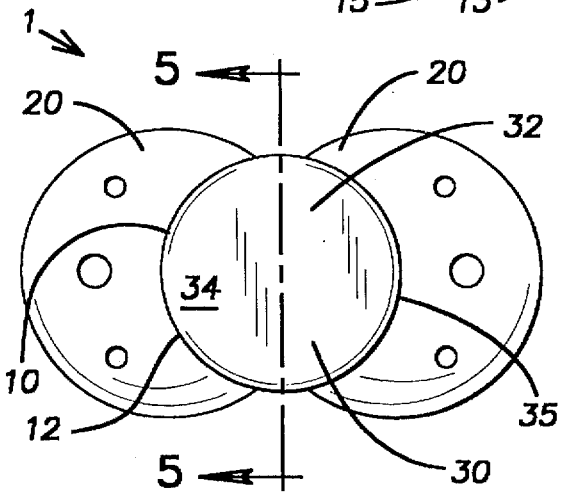
Fig.2
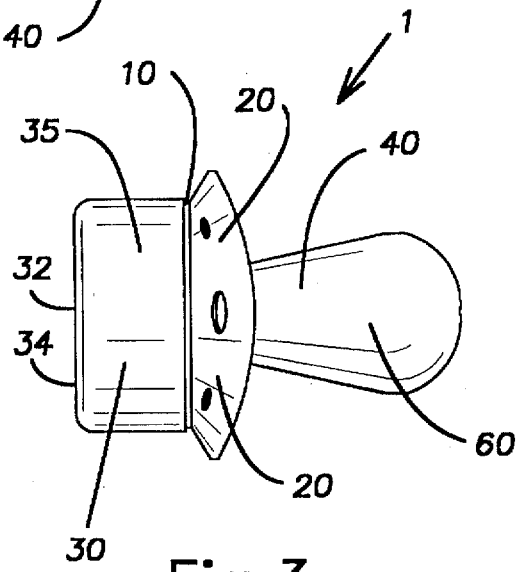
Fig.3
Fig.5
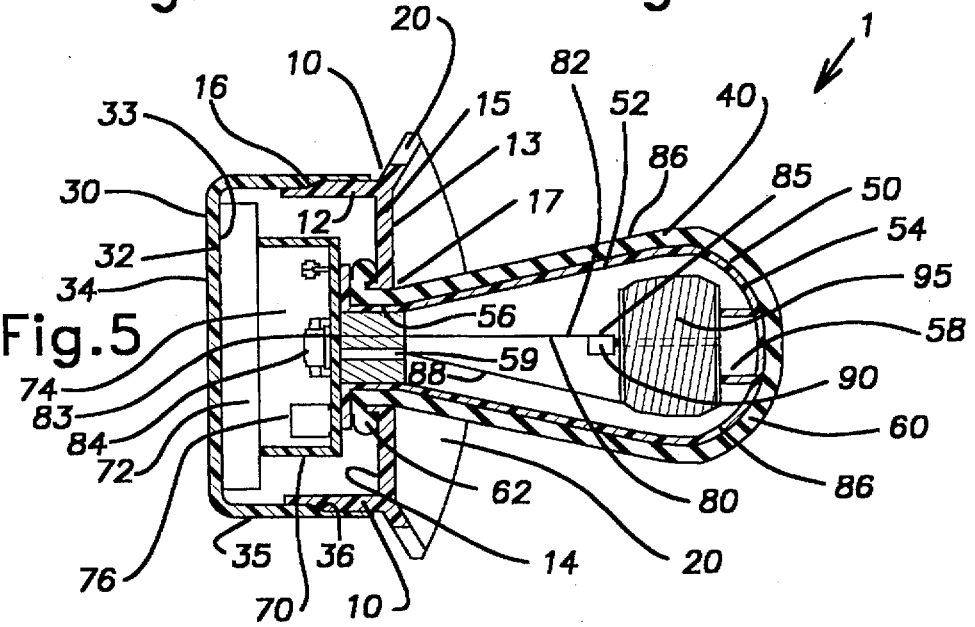

VIBRATING PACIFIER

FIELD OF THE INVENTION

The present invention relates to a vibrating infant pacifier or teething device.

BACKGROUND OF THE INVENTION

All infants undergo teething, during which new teeth rupture and emerge from the surface of the infant's gum tissue. Understandably, significant pain and discomfort is experienced by the infant during teething.

A wide array of devices have been introduced to alleviate the pain and discomfort associated with teething. Pacifiers and teething rings provide limited relief by the infant chewing or sucking the device. Such action tends to massage and soothe the infant's sensitive outer gum tissue. Unfortunately, conventional pacifiers and teething rings only partially relieve the pain and discomfort associated with teething.

A vibrating teething device is described in U.S. Pat. No. 3,115,139. Although satisfactory in some respects, there are significant disadvantages associated with that device. The device is described as having a vibrating nipple member that is powered by one or more relatively large batteries. The large batteries render the device heavy and thus potentially dangerous to the infant. The device is further described as resembling a nursing bottle and so is relatively large and cumbersome and thereby likely difficult for a small infant to grasp. Furthermore, the device utilizes an electric motor with a weight eccentrically mounted about the motor shaft. Such mechanism is relatively complex, expensive to produce, and susceptible to failure in view of the relatively high number of moving parts. Moreover, the design of the device described in the '139 patent is such that vibrations would travel, not only to the intended nipple member, but throughout the device. This is undesirable for at least two reasons. First, it is difficult for an infant to grasp, and particularly maintain a hold about, a vibrating outer cover. Second, allowing other regions and components of the device to vibrate besides the nipple member, expends additional energy other than that which is necessary and thus causes rapid battery drain.

Accordingly, there is a need for an improved vibrating pacifier or teething device that is relatively small and compact, is lightweight, provides a vibrationally isolated nipple member, is energy efficient, and that has relatively few moving parts.

SUMMARY OF THE INVENTION

The present invention achieves all of the foregoing objectives and provides a novel vibrating teething device that comprises a tuning fork vibrator unit.

In a preferred embodiment, the invention provides a pacifier comprising a vibrator unit disposed within an enclosure. The enclosure comprises a hollow nipple member through which a vibrating element of the vibrator unit extends. The device preferably further comprises an outwardly extending shield around the base of the nipple member.

More particularly, the invention provides a vibrating pacifier comprising a housing having an outwardly extending shield, the housing being engaged with a rear cover to define an interior chamber. Engaged with the housing is a tapered hollow member that projects outwardly from the housing, the member being positioned over an aperture defined in a wall of the housing so that the housing interior chamber is in communication with the interior of the hollow member. The pacifier further comprises a coil disposed within the hollow member and a vibrator unit contained within the housing interior chamber. The vibrator unit includes a spring having a magnet disposed at its distal end that projects into the hollow member such that the spring is located near the coil.

BRIEF DESCRIPTION OF THE DRAWINGS

FIG. 1 is a perspective view illustrating a preferred embodiment device in accordance with the present invention;

FIG. 2 is a rear elevational view of the device shown in FIG. 1;

FIG. 3 is a side elevational view of the device depicted in FIG. 1;

FIG. 5 is a cross-sectional view taken along line 5—5 of the preferred embodiment device shown in FIG. 2.

DESCRIPTION OF THE PREFERRED EMBODIMENT

Figure 4:
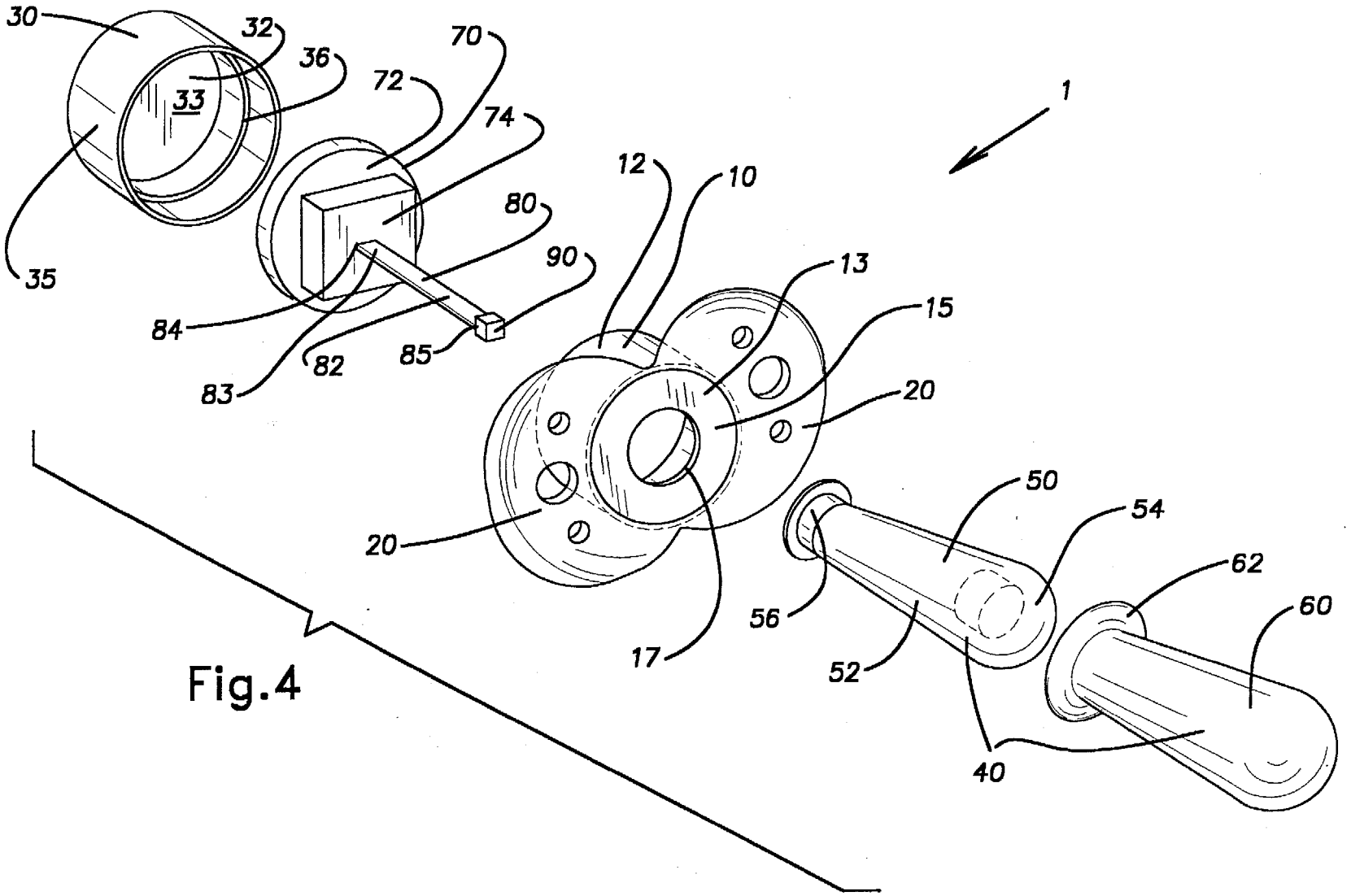
FIG. 4 is an exploded view illustrating the components of the preferred embodiment device.

The present invention provides a novel vibrating infant pacifier or teething device that is small and compact, lightweight, provides a vibrationally isolated nipple member, is energy efficient, and has relatively few moving parts.

FIGS. 1 to 3 illustrate a preferred embodiment pacifier 1 according to the present invention. Although the present invention is primarily described in terms of a pacifier, the invention encompasses other related devices such as teething rings. The preferred embodiment pacifier 1 comprises in part, a housing 10, a shield 20, a rear cover 30, and a nipple 40. The housing 10 and the rear cover 30 generally enclose a vibrator unit and other components described below. The shield 20 projects outward from the housing 10 of the pacifier 1 and generally surrounds the base of the nipple 40. The shield 20 provides a base against which an infant's lips or teeth abut when sucking or chewing the pacifier 1. The shield 20 also prevents the nipple 40 from being over-inserted into the infant's mouth either during sucking or in the event of a fall. The rear cover 30 encloses the rearward portion of the pacifier 1, as described in greater detail below. The pacifier 1 may also have provisions for a handle or ring (not shown) formed or attached along the housing 10.

FIG. 4 illustrates an exploded view of the preferred embodiment pacifier 1 comprising a vibrator unit 70 having a vibrating element such as a tuning fork 80, described in greater detail below, projecting at right angles, or substantially so, from the unit 70, the previously noted rear cover 30, the housing 10 and shield 20, and the nipple 40. The nipple 40 includes a coil cover 50, described in greater detail below, and a relatively flexible nipple cover 60 that is disposed over the coil cover 50. The rear cover 30 and the housing 10 engage each other and define, upon engagement, an interior cavity or chamber within which the vibrator unit 70 is disposed.

The rear cover 30 comprises a generally planar rear panel 32 having a front surface 33 and a rear surface 34 and having a generally circular shape. Extending around the periphery of the rear panel 32, preferably at right angles to the rear panel 32, is a sealing wall 35. The sealing wall 35 preferably projects in the same direction as that which the front surface 33 and the nipple 40 are directed, i.e. toward the front of the pacifier 1. Defined along the interior surface or inward face of the sealing wall 35 is a circumferential ledge 36. As described below, preferably the ledge 36 sealingly engages a corresponding ledge defined along a region of the housing 10. The rear cover 30 may be permanently affixed to the housing 10 or configured to be removable to enable access to the vibrator unit or other components disposed within the housing 10 of the pacifier 1.

In the preferred embodiment, the housing 10 and the shield 20 are formed as an integral one-piece component. In this preferred embodiment, best illustrated in FIGS. 4 and 5, the housing portion comprises a generally circular dividing panel 15 having a front surface 13, a rear surface 14, and a rearwardly extending circumferential wall 12. The wall 12 is preferably adjoined to the dividing panel 15 along the outer periphery of the panel 15. Defined along the exterior surface or outward face of the wall 12 is a circumferential ledge 16. Upon assembly of the pacifier 1 and thus engagement of the rear cover 30 with the housing 10, the circumferential wall 12 is inserted within the sealing wall 35. Preferably, the inside diameter of the sealing wall 35 of the rear cover 30 is approximately the same, or slightly larger, than the outer diameter of the circumferential wall 12 of the housing 10 to facilitate sealing between those components. Furthermore, the location of the ledge 36 along the interior surface of the sealing wall 35 and the location of the ledge 16 along the exterior surface of the circumferential wall 12 are such that upon assembly, the ledges 16 and 36 contact one another and serve as a stop for the engagement of the rear cover 30 and the housing 10. The configuration of the ledges 16 and 36 could be reversed so that the ledge 36 is defined along the exterior surface of the sealing wall 35 and the ledge 16 is defined along the interior surface of the circumferential wall 12.

It is preferred that the rear cover 30 and the housing 10 be permanently affixed to one another. Such affixment may be achieved by press fitting the components to one another and utilizing an effective amount of adhesive deposited on one or more of the interior surface of the sealing wall 35, the ledge 36 of the wall 35, the exterior surface of the circumferential wall 12, or the ledge 16 of the wall 12. It is also contemplated that a threaded engagement may be utilized between the rear cover 30 and the housing 10. Accordingly, threads would be provided along the exterior surface of the wall 12 of the housing 10 and also along the interior surface of the sealing wall 35. It is envisioned that a wide array of other affixment configurations may be utilized to engage the rear cover 30 and the housing 10 to each other, including but not limited to forms of snap-fit configurations, conventional threaded fasteners, hook and loop materials known as VELCRO, and adhesives either alone or in any combination with the foregoing. Regardless of the affixment configuration selected, a seal that prevents the introduction of water into the interior of the pacifier 1 should be provided.

The dividing panel 15 of the housing 10 defines a generally circular aperture 17 preferably disposed at the center of the panel 15 as best shown in FIG. 4. The aperture 17 extends across the thickness of the panel 15 and provides access between the region behind the panel 15, i.e. containing the vibrator unit 70 in the assembled pacifier 1, and the nipple 40. Upon assembly, the vibrating element or the tuning fork 80 extends through the aperture 17 and into the hollow cavity defined within the coil cover 50. Although the aperture 17 is preferably circular, such shape is not required. Other configurations are included within the present invention such as, but not limited to, slotted openings, oval, rectangular, and square-shaped apertures.

The pacifier 1 further comprises the nipple 40 which extends, approximately perpendicularly, from the dividing panel 15 of the housing 10 in the same direction as that which the front of the pacifier 1 is directed. The nipple 40 is hollow and accommodates the vibrating element such as the tuning fork 80 disposed therein as explained in greater detail below.

The nipple 40 preferably comprises a semi-rigid coil cover 50 having a hollow extension region 52, an end bulb 54, and a sealing shaft 56 disposed at the end opposite the end bulb 54. The extension region 52 is preferably tapered such as shown in the accompanying drawings such that its diameter increases along its length moving outward from the housing 10, at which a maximum diameter is reached at the region of adjoinment between the end bulb 54 and the extension region 52. The sealing shaft 56 is generally cylindrical having an aperture 59 defined along its midsection, extending generally parallel to the longitudinal axis of the coil cover 50, thereby enabling access between the hollow region within the coil cover 50 and the end of the coil cover 50 at the sealing shaft 56. The aperture 59 receives the vibrating element or tuning fork 80 which extends therethrough in the assembled pacifier 1. The aperture 59 is preferably rectangular, however other shapes are included in the preferred embodiment.

The coil cover 50 encloses and retains a coil 95 preferably disposed within the end bulb 54. The coil 95 is secured and affixed to an interior surface within the hollow coil cover 50, most preferably at the end bulb 54, by a coil mounting base 58. The base 58 can take a variety of forms, however one such configuration is a small cylindrical member oriented concentrically along the longitudinal axis of the coil cover 50 and affixed along the interior surface of the end bulb 54 as depicted in FIG. 4. The coil 95 and/or the base 58 are preferably bonded to the interior of the coil cover 50.

As noted, the nipple 40 further includes a relatively flexible and pliable nipple cover 60. The nipple cover 60 has a similar shape and size as the coil cover 50 such that the nipple cover 60 can be disposed over the exterior surface of the coil cover 50. The nipple cover 60 is preferably formed from an elastomeric material such as latex rubber so that it can be stretched over the coil cover 50. Preferably provided along an end of the nipple cover 60, opposite the end bulb 54 of the coil cover 50 shown in the accompanying drawings, is a retaining lip 62.

Upon assembly, the end of the nipple 40 containing the retaining lip 62 of the nipple cover 60 and the sealing shaft 56 of the coil cover 50, is inserted within the aperture 17 defined in the dividing panel 15 of the housing 10. The sealing shaft 56 may also include a mounting flange or lip as shown in FIG. 4 to facilitate affixment of the nipple 40 to the housing 10. In the preferred embodiment, the sealing shaft 56 includes such a lip that is subsequently affixed to a mounting surface provided by the vibrator unit 70 upon assembly of the pacifier 1.

The shield 20 is disposed around the periphery of the dividing panel 15 of the housing 10. The shield 20 preferably extends laterally outward from the housing 10, and approximately parallel to the dividing panel 15, at least near the region of adjoinment between the shield 20 and the panel 15 in the embodiment in which the shield 20 and the housing 10 are integrally formed with one another. It will also be seen by reference to the accompany drawings that the shield 20 has a slight curvature such that it is directed toward the front of the pacifier 1 as the shield 20 projects outwardly from the sides of the housing 10. One or more holes may be formed within the shield 20 as shown in the accompanying figures to reduce the weight and material costs of the pacifier 1.

Referring to FIGS. 4 and 5, the vibrator unit 70 comprises a generally circular frame 72, upon which is mounted the vibrating element or tuning fork 80, an oscillator unit 74, and one or more batteries 76. The vibrating element, oscillator 74, and batteries 76 in conjunction with the coil 95 disposed within the nipple 40, generally form a drive unit that generates vibratory movement at the bulbous end of the nipple 40. Upon assembly, the vibrator unit 70 is affixed to at least one of the rear cover 30 or the housing 10. One such means of affixment utilizes bonding the frame 72 of the unit 70 to the front surface 33 of the rear cover 30.

The vibrating element is preferably a tuning fork 80 that comprises a thin flat spring 82 having a first end 83 attached to the frame 72 at a base 84 and a free, second end 85 having a magnet 90 disposed at or near the distal end 85 of the spring 82. The oscillator unit 74 is preferably a transistor oscillator unit that in conjunction with the coil 95 disposed within the nipple 40, generates an oscillating magnetic field in the vicinity of the free end 85 of the spring 82 and the magnet 90. The coil 95 is preferably an electromagnet coil. Upon activation of the coil 95, the free end 85 of the spring 82 having the magnet 90 attached thereto is caused to move or vibrate at a frequency dependent upon the frequency of the oscillating magnetic field generated by the coil 95. The spring preferably vibrates at a frequency of from about 100 to about 400 hertz. The vibrating element or the tuning fork 80 is coupled to the nipple 40, and particularly to the coil cover 50 such that vibrations from the element or tuning fork are transmitted to the nipple 40.

The previously noted vibrator unit 70 preferably further comprises one or more switches that complete an electrical circuit between one or more batteries 76, the oscillator unit 74, and/or the coil 95. It is most preferred to utilize a pressure switch such as switch 86 shown in FIG. 5. It is preferred to dispose the pressure switch 86 within the nipple 40, and most preferably near the distal end or end bulb 54 of the nipple 40. Placement of the pressure switch 86 within the nipple 40 enables the vibrator unit 70 to be activated at only those times when compressive force is placed or exerted upon the nipple 40, such as by an infant when sucking or chewing the pacifier 1. This eliminates the need for a conventional on/off switch, and significantly improves the life of the batteries 76 incorporated within the pacifier 1.

The pressure switch 86 is preferably a thin membrane switch disposed adjacent the wall of the coil cover 50. In such an embodiment, the switch comprises a first thin flexible layer in which two electrical conductors are disposed generally along the same plane and horizontally separated by some distance. The two conductors can be connected to a power source and load and constitute an open circuit. The switch further comprises an adjacent, second thin flexible layer disposed over or under the first layer, the second layer containing a third electrical conductor. Upon application of a compressive force upon the layers at the location of the switch, the third conductor is placed in electrical connection with the other two conductors in the first layer, thereby completing an electrical circuit. Alternatively, the pressure switch 86 can utilize a first resilient layer, thin and flexible, that contains a first electrical conductor in electrical association with a circuit, and a second resilient thin flexible layer containing a second electrical conductor in electrical association with the circuit disposed over the first layer. The first and second layers are vertically spaced from one another such that in the absence of a compressive force upon the switch 86, the circuit remains open. Upon application of such force, the first and second electrical conductors are contacted with each other and the circuit is closed. Spacing or electrical insulation between the layers can be achieved by one or more thin layers of dielectric materials such as plastic, cellulose or paper materials, or other known insulators in which openings are provided through which electrical connection is established. The electrical conductors can be formed from nearly any conventional electrically conducting material including metallic foil and thin layers or coatings of electrically conductive carbon black.

The pressure switch 86 is electrically connected to the vibrator unit 70 and/or the coil 95 by wiring 88 disposed within the nipple 40 and the enclosure formed by the housing 10 and the rear cover 30.

Since the housing 10 is a separate component from the nipple 40 and/or the vibrator unit 70, the housing 10 is vibrationally isolated from the vibrating nipple 40. Accordingly, minimal or no vibrations are transmitted to the housing 10 from the vibrator unit 70. It is contemplated that vibration insulating layers such as resilient foamed materials could be incorporated within the device to further minimize transmission of vibration to the housing 10 and/or the rear cover 30. For instance, a foam layer could be disposed between the rear cover 30 and the vibrator unit 70.

The components of the pacifier 1 are appropriately sized as follows. The exterior dimensions and configuration of the nipple 40 are such that an infant, typically of an age during which teething occurs, can readily suck or chew the nipple 40. The interior dimensions of the hollow region of the nipple 40 and the exterior dimensions and length of the tuning fork 80 and magnet 90 are such that the tuning fork 80 and magnet 90 can be inserted within the hollow region of the nipple 40, and particularly such that the magnet 90 be disposed adjacent to the coil 95, so that vibratory movement of the tuning fork 80 and magnet 90 is readily transmitted to the nipple 40.

Although not critical to the present invention, typical dimensions of the preferred embodiment pacifier 1 are as follows. The overall length of the assembled pacifier 1, that is from the rear surface 34 of the rear cover 30 to the distal end of the nipple 40 is about 1.95 inches. The width of the shield 20 as measured across its maximum span, i.e. from side to side, is about 2.5 inches. The height of the shield is about 1.5 inches. The diameter of the rear cover 30 is about 1.25 inches.

The previously described vibrator unit 70 requires extremely low amounts of power to operate, particularly as compared to known eccentrically weighted electric motors. This feature provides for long battery life. In view of the use of the pressure switch 86 and low power tuning fork vibrator unit 80, it is possible and preferred to employ permanent internal batteries for the pacifier 1. Accordingly, the housing 10 and the rear cover 30 can be permanently affixed to one another, and provide a seal around the vibrator unit 70 to prevent the introduction of moisture into the interior of the pacifier 1.

The materials of construction for the pacifier 1 may include any materials commonly used for infant devices or pacifiers. The housing 10, shield 20, and the rear cover 30 are preferably formed from a safe, durable, and semi-rigid material such as plastics known in the art and which are typically employed for infant toys and devices. The nipple cover 60 is preferably formed from a pliable and elastic material such as latex rubber.

In addition to the foregoing embodiment, the present invention further provides alternate embodiments in which the vibrator unit 70 is enclosed within housings having other forms than that previously described. For instance, the housing may comprise a front or side cover from which the housing interior is accessible. The housing may comprise one or more mechanical latching components instead of, or in addition to, the components described herein. Remote power sources are also envisioned which could be electrically connected to the device by methods known in the art.

While the foregoing details are what is felt to be the preferred embodiments of the present invention, no material limitations to the scope of the claimed invention are intended. Further, the features and design alternatives that would be obvious to one of ordinary skill in the art are considered to be incorporated herein. The scope of the invention is set forth and particularly described in the claims hereinbelow.

What is claimed is:

1. A vibrating teething device comprising:

an enclosure defining an interior cavity, said enclosure having (i) a front panel defining an aperture extending through the thickness of said panel, and (ii) a member extending from said front panel and defining a hollow region across its length, said hollow region being accessible from one end of said member, said aperture providing access between said interior cavity of said enclosure and said hollow region through said one end of said member; and a tuning fork vibrator unit disposed in said interior cavity of said enclosure, said vibrator unit including a vibrating element extending into said hollow region of said member and coupled therewith such that upon activation of said vibrator unit, vibrations from said vibrating element are transmitted to said member.

2. The vibrating teething device of claim 1, wherein said device further includes:

a frame having said vibrating element extending therefrom;

a tuning fork comprising a spring having a first end affixed to said frame, and a second free end with a magnet disposed proximate to said free end; and a coil unit disposed within said hollow member, said coil for generating an oscillating magnetic field proximate to said magnet to cause said magnet and said second free end of said spring to vibrate, wherein said resulting vibrations of said spring are transmitted to said hollow member.

3. The vibrating teething device of claim 2, wherein said device further includes:

an electrical power source for energizing said coil unit.

4. The vibrating teething device of claim 3 wherein said electrical power source is disposed in said enclosure.

5. The vibrating teething device of claim 2 wherein said coil unit comprises an electromagnetic coil.

6. The vibrating teething device of claim 2 wherein said spring is a thin flat spring.

7. The vibrating teething device of claim 2 wherein said spring vibrates at a frequency of from about 100 to about 400 hertz when said coil unit is activated.

8. The vibrating teething device of claim 1, wherein said enclosure comprises:

a housing including said front panel and a rearwardly extending wall; and a rear cover including a rear panel and a sealing wall generally extending at right angles to said rear panel.

9. The vibrating teething device of claim 8 wherein said rearwardly extending wall of said housing includes a first ledge disposed along an outwardly facing surface of said wall, and said sealing wall of said rear cover includes a second ledge disposed along the interior facing surface of said sealing wall.

10. The vibrating teething device of claim 9 wherein said rearwardly extending wall of said housing is adapted to be engaged with said sealing wall of said rear cover.

11. The vibrating teething device of claim 1 further comprising a pressure switch disposed on said hollow member, which when activated enables operation of said tuning fork vibrator unit and thus vibration of said hollow member.

12. The vibrating teething device of claim 1, wherein said enclosure further has a shield disposed at least substantially around the perimeter of said hollow member and proximate to said one end of said hollow member and projecting outward from said hollow member.

13. A pacifier comprising:

a rear cover having a rear panel and a sealing wall projecting from said rear panel, said sealing wall defining a first ledge extending around the periphery of said sealing wall;

a housing having a dividing panel and a circumferential wall extending from said dividing panel, said circumferential wall defining a second ledge along the periphery of said circumferential wall, said second ledge being adapted to engage said first ledge of said sealing wall, said dividing panel defining an aperture extending through said dividing panel, said housing further having a hollow member projecting outward from said dividing panel at the location of said aperture; and a tuning fork vibrator unit generally disposed between said rear cover and said housing, said vibrator unit comprising a vibrating element and a drive unit for inducing vibratory movement to said vibrating element, wherein said vibrating element extends through said aperture defined in said dividing panel and into said hollow member.

14. The pacifier of claim 13 wherein said vibrating element is vibrationally coupled to said hollow member.

15. The pacifier of claim 13 further comprising a pressure sensitive switch disposed in said hollow member and electrically connected to said vibrator unit, wherein upon closure of said switch, said vibrator unit is activated and said vibrating element vibrates.

16. The pacifier of claim 13 wherein said vibrator unit further comprises a coil unit disposed in said hollow member for effecting oscillatory movement of said tuning fork.

17. The pacifier of claim 16 wherein said oscillatory movement of said tuning fork causes said vibrating element to vibrate.

18. The pacifier of claim 13 further comprising a shield disposed at least substantially around the perimeter of said hollow member and proximate to said one end of said member and projecting outward from said member.

19. A vibrating pacifier comprising:

a housing including a substantially circular dividing wall, said dividing wall having a front surface and a rear surface and defining an aperture extending therethrough, said housing further including a rearwardly extending circumferential wall adjoined to the outer periphery of said dividing wall;

a shield adjoined to said housing and extending generally laterally outward therefrom;

a rear cover having a substantially circular rear panel having a front surface and a rear surface, said rear cover further having a forwardly extending sealing wall adjoined to the outer periphery of said rear panel, said rear cover being affixed to said housing by engagement between said sealing wall and said circumferential wall thereby defining an interior chamber;

a tapered hollow coil cover defining an interior hollow region, said coil cover having a first end providing a sealing shaft and aperture defined in said first end, and a second opposite end, said coil cover being affixed to said housing by engagement between said sealing shaft and said dividing wall such that said aperture defined in said first end of said coil cover is aligned with said aperture defined in said dividing wall;

a coil disposed within said interior hollow region of said coil cover;

a vibrator unit including a frame, an oscillating unit, a battery, said oscillating unit and said battery secured to said frame, and a spring projecting from said frame, said spring affixed to said frame at a first end of said spring and said spring having a magnet disposed at its second distal end, said vibrator unit disposed within said interior chamber defined by said rear cover and said housing and oriented therein such that said spring projects through said aperture defined in said dividing wall and through said aperture defined in said first end of said coil cover and said magnet disposed at said second end of said spring is proximate to said coil.

20. The vibrating pacifier of claim 19 further comprising:

a switch disposed on said coil cover, said switch configured such that upon application of a compressive force upon said coil cover, said switch completes an electrical circuit between said battery and said oscillating unit, whereby vibratory movement of said spring is effected.

21. The vibrating pacifier of claim 19 further comprising:

a nipple cover disposed over said coil cover, said nipple cover including a retaining lip at an end of said nipple cover proximate to said sealing shaft.

* * * * *